United States Patent [19]

Peebles

[11] Patent Number: 4,486,918

[45] Date of Patent: Dec. 11, 1984

[54] SNAP ACTION REMOVABLE KNOB

[75] Inventor: Douglas D. Peebles, Ft. Lauderdale, Fla.

[73] Assignee: Motorola, Inc., Schaumburg, Ill.

[21] Appl. No.: 489,892

[22] Filed: Apr. 29, 1983

[51] Int. Cl.[3] ..... B65D 25/28; B25G 1/00

[52] U.S. Cl. ..... 16/121; 16/DIG. 30; 16/DIG. 40; 24/241 S; 24/607; 74/553; 403/348

[58] Field of Search ..... 16/114 R, 118, 121, 16/123, DIG. 24, DIG. 30, DIG. 40; 403/348; 74/553, 556, 557; 24/241 S, 607

[56] References Cited

U.S. PATENT DOCUMENTS 2,271,265 1/1942 Kost .
3,011,794 12/1961 Vaughn .
3,390,903 7/1968 Sabonis .
3,413,953 12/1968 Kuhl et al. .
3,476,421 11/1969 Torres .
3,887,222 6/1975 Hammond .
3,986,780 10/1976 Nivet .
4,043,685 8/1977 Hyams .

*Primary Examiner*—Fred A. Silverberg
*Attorney, Agent, or Firm*—Joseph T. Downey; Edward M. Roney; James W. Gillman

[57] ABSTRACT

A knob assembly is provided which includes a knob having an integral shaft. The knob further includes a circular groove therein, and first and second cams situated in the groove. A knob receiving member includes an aperture in which the shaft of the knob is situated. Two snap fingers of flexible material extend from the sides of the aperture to engage the knob when the knob is pressed into the aperture. The knob is conveniently removed from the aperture by rotating the knob until the first and second cams contact and push the first and second snap fingers, respectively, out of the groove.

6 Claims, 4 Drawing Figures

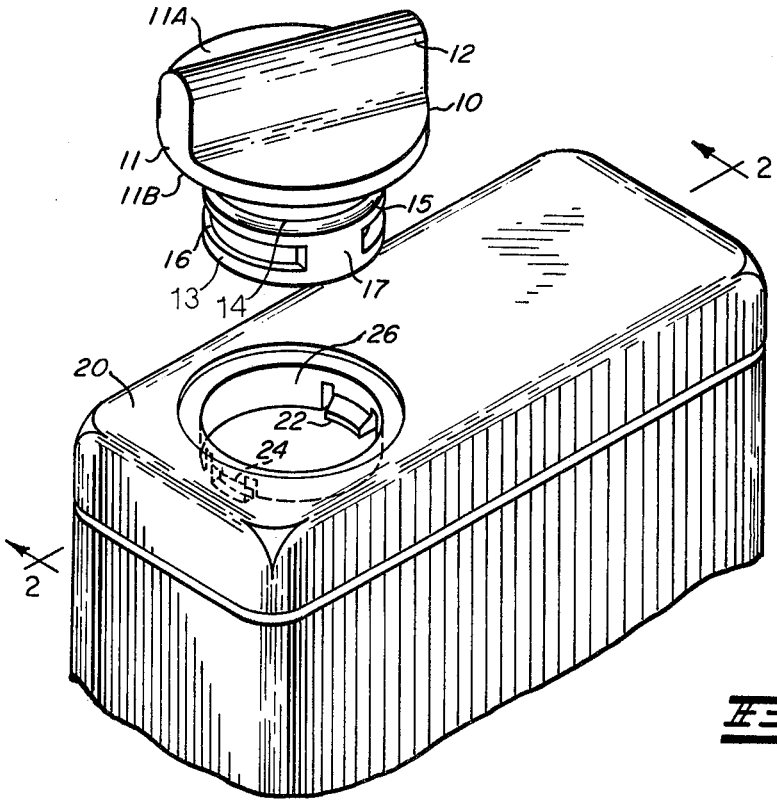
Fig. 1
Fig. 2
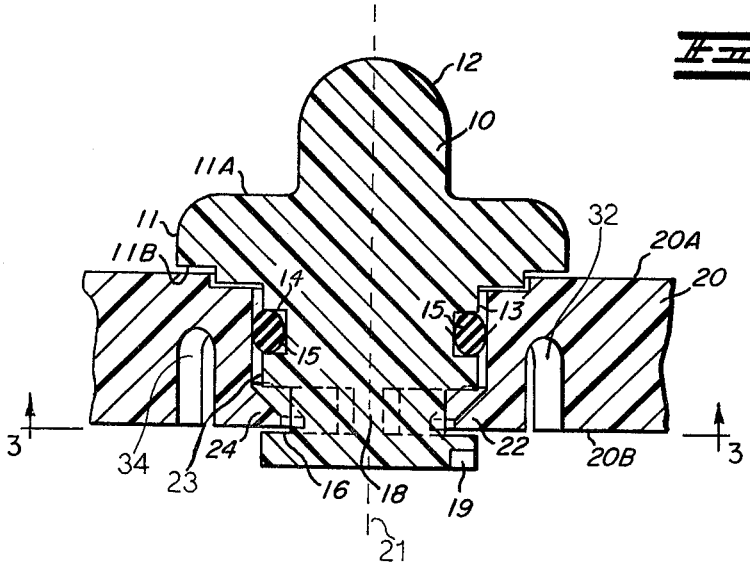

SNAP ACTION REMOVABLE KNOB

BACKGROUND OF THE INVENTION

This invention relates to rotatable knobs and, more particularly to a snap action rotatable knob which is easily removed from a knob receiving member into which the knob is positioned.

DESCRIPTION OF THE PRIOR ART

Conventional rotating knobs for electronic and other devices are typically mounted on a shaft protruding through a front panel of such devices. The knob is typically held to the shaft by a set screw, a retaining clip or other similar retaining apparatus. Although such knobs are removable from the shafts on which they are situated, additional tools such as screw drivers, allen wrenches, and the like must often be employed to achieve removal. Moreover, conventional knob-shaft assemblies are limited in that they employ a separate shaft to transfer rotational force from one side of a knob receiving member or panel to the remaining side of the panel. When such conventional shafts are to be removed from the panel, it is necessary to gain access to the back side of the panel.

One object of the present invention is to provide a rotating knob which includes an integral shaft which may be removed from the knob receiving member from the front panel side without the need for gaining access to the back of the panel.

Another object of the present invention is to provide a rotating knob which requires no setscrews, retaining clips or other non-integral retaining devices to achieve knob mounted and knob removal.

Yet another object of the invention is to provide a rotating knob which requires no tools for removal.

These and other objects of the invention will become apparent to those skilled in the art upon consideration of the following description of the invention.

BRIEF SUMMARY OF THE INVENTION

The present invention is directed to providing a rotating knob which includes an integral shaft, the knob and shaft being removable from the front side of a knob receiving member without the use of any additional tools.

In accordance with one embodiment of the invention, a knob assembly includes a knob having a substantially cylindroidal shaft portion with a substantially circular groove therein. The knob includes first and second cams situated spaced apart in the groove by a predetermined angle therebetween. The knob assembly further includes a knob receiving member having upper and lower opposed surfaces. An aperture is situated in the knob receiving member for receiving the shaft of the knob therein. The knob receiving member includes first and second flexible engaging members situated extending into the aperture so as to engage the groove of the knob when the shaft portion of the knob is inserted in the aperture. The first and second engaging members are situated spaced apart in the aperture by an angle therebetween substantially equal to the predetermined angle. Thus, the knob is removable from the knob receiving member when the knob is appropriately rotated such that the first and second cams contact and push the first and second engaging members, respectively, out of said groove.

The features of the invention believed to be novel are set forth with particularity in the appended claims. The invention itself, both as to organization and method of operation, together with further objects and advantages thereof, may best be understood by reference to the following description taken in conjunction with the accompanying drawings.

DESCRIPTION OF THE DRAWINGS

FIG. 1 is an exploded perspective view of the knob assembly of the present invention.

FIG. 2 is a cross section of the knob assembly of the present invention.

DETAILED DESCRIPTION OF THE PREFERRED EMBODIMENT

Figure 3:
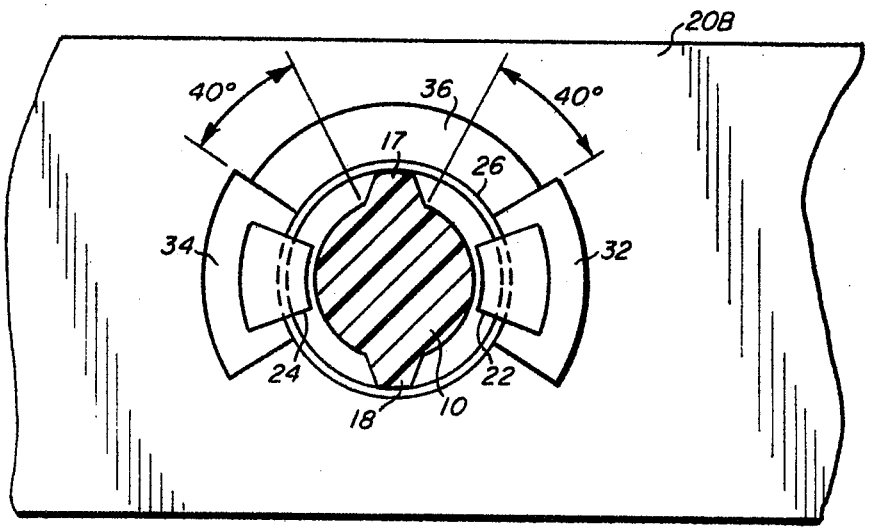
FIG. 3 is a cross section of the knob assembly of FIG. 2 showing the knob in the working position.

FIG. 1 illustrates one embodiment of the knob assembly of the present invention. The knob assembly includes a rotary knob 10 fabricated from a relatively rigid material. For example, plastics, metals, and the like may be employed to fabricate knob 10 as long as the particular material selected exhibits sufficient structural integrity to push apart the later described snap fingers 22 and 24 when knob removal is desired. The removability feature of knob 10 is discussed later in more detail.

In this embodiment of the invention, knob 10 includes a circular disk 11 having upper and lower opposed surfaces, 11A and 11B, respectively. A raised ridge 12 is situated running across upper knob surface 11A to facilitate grasping knob 10 by hand. Knob 10 includes a cylindroidal shaft 13 centrally situated extending from lower kob surface 11B, as shown in FIG. 1. Shaft 13 is oriented substantially perpendicular to lower knob surface 11B.

Knob receiving member 20 includes an aperture 26 exhibiting a sufficiently large diameter to receive shaft 13 therein. The diameter of shaft 13 is sufficiently large to produce a snug fit when knob 10 is situated within aperture 26, but not so large as to prevent ease of rotation of knob 10 when so situated.

A groove 14 is situated in shaft 13 around the circumference thereof, as shown in FIG. 1. An O-ring type gasket 15 is situated in groove 14 such that when knob 10 is pressed into aperture 26, gasket 15 provides a water seal against external undesired liquids to which the knob assembly of FIG. 1 may be subjected. Knob 10 further includes a second groove 16 situated around the circumference of the lower most portion of shaft 13 as shown in FIG. 1. Cams 17 and 18 are situated in groove 16 approximately 180° apart as measured with respect to each other and the center of knob 10 which is located on knob axis 21 (center line 21) as shown in FIG. 2. In this embodiment of the invention, cams 17 and 18 are formed by tapering portions of groove 16 to rise to the external surface 23 (FIG. 2) of shaft 13 at the cites selected for cams 17 and 18. When knob 10 is pressed into aperture 26 of knob receiving member 20, shaft 13 pushes fingers 22 and 24 (later discussed) apart until fingers 22 and 24 engage and snap into groove 16. Knob 10 is thus retained in aperture 26.

FIG. 2 is a cross section of the knob assembly of FIG. 1 along a section line 2—2. Knob 10 is shown in the working position with groove 16 being engaged by flexible snap fingers 22 and 24 which extended into aperture 26 of knob receiving member 20. Opposed surfaces 20A and 20B are defined as the upper and lower surfaces of the portion of knob receiving member 20 at which knob 10 is located. Knob receiving member 20 is fabricated from a material which permits snap fingers 22 and 24 to flex and be subjected to stress without fracturing. For example, the flexible members which form these snap fingers 22 and 24 are fabricated from polycarbonates and other plastic materials. Other embodiments of the invention employ metallic flexible snap fingers. However, the preferred embodiment of the invention employs flexible plastic snap fingers 22 and 24 which are integral parts of knob receiving member 20.

The section view of FIG. 2 shows cam 18 as a dotted line structure in the lower portion of knob 10. In this view, cam 18 is on the backside of the knob which is hidden from view. An indented portion 19 adjacent groove 16 is shown on the bottom of knob 10 of FIG. 2. Indented portion 19 is employed to receive a drive member which may engage a switch or other member whose position is to be changed by rotary motion imparted to knob 10.

FIG. 3 is a sectional view of the knob assembly of FIG. 2 taken along section line 3—3. The view of FIG. 3 shows the knob assembly with knob 10 being in the working position, as opposed to the removal position later depicted in FIG. 4. As seen in FIG. 3, flexible snap fingers 22 and 24 extend from deeply recessed regions 32 and 34, respectively. Regions 32 and 34 are recessed into lower receiving member surface 20B. In some embodiments of the invention, a more shallow region 36 is recessed into surface 20B surface 20B between recessed portions 32 and 34 as shown in FIG. 3. Region 36 is not essential. In the embodiment of the invention shown in FIG. 3, the knob assembly permits knob 10 to substantially freely rotate for approximately 80°. That is, from the knob orientation at which cams 17 and 18 are vertically oriented, as in FIG. 3, knob 10 rotates 40° clockwise from the vertical until cam 17 contacts snap finger 22 and cam 18 contacts finger 24. Knob 10 is also permitted to rotate counterclockwise approximately 40° from the vertical until cam 17 contacts snap finger 24 and cam 18 contacts snap finger 22. Thus, knob 10 is permitted to rotate approximately 80° in the total. In the present embodiment of the invention, it is noted that cams 17 and 18 are 180° apart, and that snap fingers 22 and 24 are situated in receiving member 20 and oriented 180° apart with respect to each other. The angle between cams 17 and 18 is substantially equal to the angle between fingers 22 and 24. It will be appreciated by those skilled in the art that changing the angle at which snap fingers 22 and 24 are located with respect to each other and similarly changing the angle at which the cams 17 and 18 are oriented will result in a change in the total amount of rotation which knob 10 is permitted.

Figure 4:
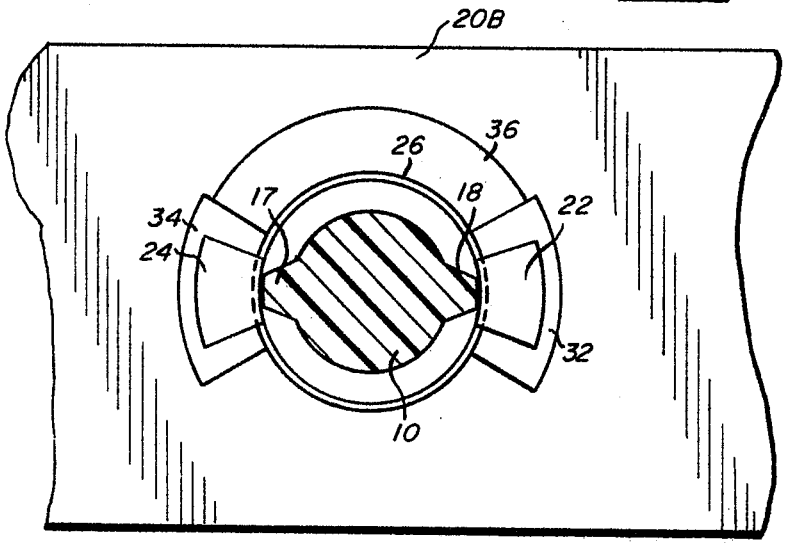
FIG. 4 is a cross section of the knob assembly of FIG. 2 showing the knob in the removal position.

FIG. 4 shows the knob assembly of the present invention with knob 10 being oriented in the knob removal position. That is, knob 10 is rotated beyond the approximately 80° of rotation which it is permitted in its working position until cams 17 and 18 contact and push apart snap fingers 24 and 22, respectively. When snap fingers 22 and 24 are pushed away from aperture 26 in this manner, knob 10 is defined to be in the knob removal position. When knob 10 is oriented in such knob removal position, the snap fingers 22 and 24 no longer engage groove 16 to hold knob 10 within aperture 26. Thus, in the knob removal position, knob 10 is easily removed from aperture 26 by simply pulling knob 10 out of aperture 26.

The foregoing describes a knob assembly which includes a knob having an integral shaft and which is capable of being mounted in an aperture without the use of set screws, clips, or other retaining members. Moreover, the knob of the present invention requires no tools for removal and may be removed from the front side of the panel or knob receiving member in which the knob is situated.

While only certain preferred features of the invention have been shown by way of illustration, many modifications and changes will occur to those skilled in the art. It is, therefore, to be understood that the present claims are intended to cover all such modifications and changes as fall within the true spirit of the invention.

What is claimed is:

1. A knob assembly comprising:

a knob including a substantially cylindroidal shaft portion having a substantially circular groove therein, and first and second cams situated spaced apart in said groove by a predetermined angle therebetween, a knob receiving member having upper and lower opposed surfaces including an aperture for receiving the shaft of said knob therein, and first and second flexible engaging means being situated extending into said aperture so as to engage said groove when the shaft portion of said knob is inserted in said aperture, said first and second engaging means being situated spaced apart in said aperture by an angle therebetween substantially equal to said predetermined angle, whereby said knob is removable from said knob receiving member when said knob is appropriately rotated such that said first and second cams contact and push said first and second engaging means, respectively, out of said groove.

2. The knob assembly of claim 1 wherein said predetermined angle is approximately equal to 180°.

3. The knob assembly of claim 1 wherein said knob includes an indented portion adjacent said groove for engaging a member to be moved.

4. The knob assembly of claim 1 wherein said knob is comprised of a plastic material.

5. The knob assembly of claim 1 wherein said knob receiving member is comprised of a flexible material capable of being subjected to stress without fracturing.

6. The knob assembly of claim 1 wherein said knob receiving member is comprised of a polycarbonate material.

* * * * *